US008314567B2

(12) United States Patent
Ploquin et al.

(10) Patent No.: US 8,314,567 B2
(45) Date of Patent: Nov. 20, 2012

(54) DISPLAY APPARATUS

(75) Inventors: Didier Ploquin, Parthenay de Bretagne (FR); Philippe Marchand, Vitre (FR); Gerard Morizot, Voiron (FR)

(73) Assignee: Thomson Licensing, Boulogne-Billancourt (FR)

( * ) Notice: Subject to any disclaimer, the term of this patent is extended or adjusted under 35 U.S.C. 154(b) by 611 days.

(21) Appl. No.: 12/310,750

(22) PCT Filed: Aug. 8, 2007

(86) PCT No.: PCT/EP2007/058251

§ 371 (c)(1),
(2), (4) Date: Mar. 5, 2009

(87) PCT Pub. No.: WO2008/028743

PCT Pub. Date: Mar. 13, 2008

(65) Prior Publication Data

US 2009/0237004 A1 Sep. 24, 2009

(30) Foreign Application Priority Data

Sep. 6, 2006 (EP) ..... 06300932

(51) Int. Cl.
*H05B 39/02* (2006.01)

(52) U.S. Cl. ..... 315/209 R; 315/210; 315/226

(58) Field of Classification Search ..... 315/209 R, 315/160, 161, 172, 185 R, 186, 192, 193, 315/210, 217, 224, 226, 291, 294, 299, 306, 315/307, 312, 313, 320, 323, 362
See application file for complete search history.

(56) References Cited

U.S. PATENT DOCUMENTS

2004/0090403 A1 5/2004 Huang

FOREIGN PATENT DOCUMENTS

| | | |
|---|---|---|
| DE | 10103611 | 8/2002 |
| DE | 10358447 | 12/2003 |
| JP | 01104754 | 7/1989 |
| JP | 2001028461 | 1/2001 |
| JP | 2002190395 | 7/2002 |
| JP | 2005310997 | 11/2005 |
| WO | WO 2004/100612 | 11/2004 |

OTHER PUBLICATIONS

Search Report Dated March 3, 2008.
Balogh, Laszlo, "Design and Application Guide for High Speed MOSFET Gate Drive Circuits", http://focus.ti.com/lit/ml/slup169/slup169.pdf.

*Primary Examiner* — Douglas W Owens
*Assistant Examiner* — Jianzi Chen
(74) *Attorney, Agent, or Firm* — Tutunjian & Bitetto, P.C.

(57) ABSTRACT

A circuit for controlling illumination means in a display includes illumination means arranged in a series-connection that are supplied with an essentially constant current. For individually controlling the illumination means, switches are provided for bypassing individual illumination means, maintaining the essentially constant current in the series-connection. The switches are floating with respect to a ground potential. A coupling means is thus provided for proper control of the switches. In a development of the invention a floating local power supply is provided with each illumination means and switch for operating the switch. The local power supply is, in one embodiment, powered by the control signal that is used for controlling the bypass switch. In another embodiment provision is made for supplying power to the floating local power supply. A driving method according to the embodiments of the circuit is also described.

23 Claims, 7 Drawing Sheets

DISPLAY APPARATUS

This application claims the benefit, under 35 U.S.C. §365 of International Application PCT/EP2007/058251, filed Aug. 8, 2007, which was published in accordance with PCT Article 21(2) on Mar. 13, 2008 in English and which claims the benefit of European patent application No. 06300932.8, filed Sep. 6, 2006.

The invention relates to display apparatus using transmissive light valves that modulate light emitted by a backlight to form an image. The invention also relates to display apparatus such as projection displays, in which light is modulated by reflective light valves. The light valve is controlling the amount of light that is visible on a screen. The term display will be used in the following without distinguishing between displays that use reflective or transmissive light valves. Typically, each light valve represents one pixel of the image. In the case of a colour image reproduction a triplet of light valves for the primary colours red, green and blue may be used for one pixel, thereby allowing for composing a wide variety of colours by mixing the primary colours correspondingly. In this case, the backlight typically is a uniform white light. It is also possible to produce colour images by sequentially producing monochromatic images of the primary colours. In this case, mixing of the colours is performed in the observer's eye by integration of the monochromatic images over time. Today's display apparatus often use liquid crystals as transmissive light valve, which are controlled for transmitting a desired amount of light from the backlight towards a front surface of the apparatus. The front surface of the apparatus is also referred to as a screen. Projection display apparatus may also use reflective light valves formed by micro mirrors, also known as DMD, or liquid crystals on silicon, also referred to as LCOS.

Today's liquid crystal displays, or LCD, offer a contrast ratio in the range of 1:1000. This is due to light leaking through a fully closed light valve. However, the human eye is capable of discerning contrast ratios in the range of 1:100.000. It is generally known from the prior art to control the intensity of an LCD backlight in order to improve the contrast ratio of the display. In this case the backlight of the display apparatus is adjusted to provide the highest brightness required for a pixel in the image that is to be reproduced. Common display apparatus using light valves are equipped with gas discharge lamps as a backlight, for example cold cathode fluorescent lamps, also referred to by the acronym CCFL, or gas discharge lamps in general. Further, arc lamps or halogen lamps may be used, in particular in projection devices. The brightness of those commonly used backlights is controlled, e.g., by varying the supply voltage and/or the current through the lamps.

Only recently light emitting diodes, or LEDs, have been available which provide the required amount of light to be useful as a backlight or projection light source for a display apparatus as referred to in this specification. The LEDs may either be LEDs emitting white light or may be formed by triplets of LEDs each emitting light in a primary colour, wherein white light is obtained by mixing the primary colours accordingly, either simultaneously or sequentially over time. However, conventional dimming of LEDs by accordingly controlling the current through the LEDs also results in a change in the perceived colour, which is generally undesirable.

In order to overcome the change in the perceived colour it is known to use currents having constant magnitude for driving the LEDs and to switch these currents having constant magnitude in a pulsed manner in order to achieve the desired perceived light intensity. The perceived light intensity depends on the number and/or duration of the pulses. To this end, a circuit for setting the duty cycle is generally known which includes a PLL stage that is locked to the vertical synchronisation pulse of the video signal. In the known circuit a counter/comparator is used for setting the duty cycle in accordance with the vertical synchronisation pulse. Circuits for adjusting the duty cycle are disclosed in the European patent application no. EP 06290910, which is herewith incorporated in the following specification by reference.

In a backlight using LEDs, each LED is lit at a constant predetermined value, e.g. the maximum admissible pulse current, during short periods of time. In order to achieve a variable light intensity, the short periods of time are repeated in a pulse-density-like modulation. In another variant the variable light intensity is achieved by a pulse-width modulation. The pulses are preferably synchronised with the frame rate, the field rate or the line rate. That is to say, the individual LEDs are arranged in lines and columns, and LEDs in a line may be lit when the video data for the line has been applied to the corresponding light modulators of that line. To this end, the LEDs need to be addressable individually or in corresponding groups. In any case it is necessary to control the current at some degree of precision.

There are four generally known connection concepts for connecting LEDs in a matrix-like arrangement for achieving controllable individual illumination or illumination of an area.

In a first concept a supply voltage is fed to each LED via a resistor and a switch. The switch is preferably located at the ground connection of the arrangement for allowing a control signal to be referred to ground as a reference potential. FIG. 1 shows an exemplary schematic of this concept. The supply voltage VDD is the same for all elements in the whole matrix. The current through the LEDs 111, 121, 131, 141 is adjusted by the series resistors 112, 122, 132, 142. The forward voltage of the LEDs 111, 121, 131, 141, which may vary with temperature, has an impact on the current through the LEDs 111, 121, 131, 141. In order to achieve a good control of the current through the LEDs 111, 121, 131, 141 the supply voltage VDD must be substantially higher than the forward voltage of the LEDs 111, 121, 131, 141, at least twice the forward voltage of the LEDs 111, 121, 131, 141. The resistors 112, 122, 132, 142, in this case, dissipate the same amount of energy as the LEDs 111, 121, 131, 141.

In a second concept, shown in FIG. 2, the resistors 212, 222, 232 are integrated into controllable current sources 210, 220, 230, or linear regulators. In this concept the resistors are used for measuring the current through the LEDs 211, 221, 231. This concept allows for a tighter control of the current. The power is mainly dissipated in the active regulating element. As the resistor is less susceptible to variation with temperature, the supply voltage can be chosen to be smaller than for the first concept while still achieving the same or better regulation. Switching on and off the current through the LED can be achieved by a series switch 213, 223, 233 or by controlling the regulator accordingly. Both variants are shown in the figure, the signals S1, S2, S3 indicate the control signals for switching on and off the current. The magnitude of the current is controlled by the internal references 214, 224, 234. A further adjustment of the magnitude of the current, which is not possible in the first concept shown in FIG. 1, is possible by applying corresponding control signals A1, A2, A3.

In a third concept, shown in FIG. 3, the linear regulators of FIG. 2 are replaced by switch mode power supplies 310, 320, 330 including inductances that are series-connected with the LEDs 311, 321, 331. In this way it is possible to substantially reduce the power that is dissipated in the control circuitry to the losses in the switches, the current sense resistors 312, 322, 332 and the internal resistance of the inductances. Like in the second concept shown in FIG. 2 the magnitude of the current is controlled by the internal references 314, 324, 334. A further adjustment of the magnitude of the current is likewise possible by applying corresponding control signals A1, A2, A3.

In a fourth concept multiple LEDs 411, 421, 431 are connected in series and are supplied with a constant current. The constant current may be supplied by a switch mode power supply 410, as shown in FIG. 4, ensuring good power efficiency. Each LED 411, 421, 431 can be bypassed by an accordingly controlled switch 413, 423, 433. As the current $I_{LED}$ is kept constant bypassing one or more LEDs 411, 421, 431 in the series-connection will not result in changes in the intensity of illumination provided by those LEDs that are not bypassed. This concept intrinsically provides a good coupling of the current through the LEDs 411, 421, 431 arranged in the same series-connection. Switching on and off the individual LEDs 411, 421, 431 is performed by accordingly controlling the bypass switches 413, 423, 433 associated to the LEDs 411, 421, 431. The switches 413, 423, 433 are controlled by according control signals S1, S2, S3. When a switch is closed, the current is routed through the switch, the voltage across the switch is essentially zero and consequently the LED is not lit. When a switch is open, the current is routed through the LED and the LED emits light. The supply voltage VDD that is required for the desired current varies with the number of LEDs that is bypassed, and is essentially proportional to the number of not-bypassed LEDs. The current through the LEDs is controlled by comparing the voltage drop across a current sense resistor 412 with an internal reference 414. Further adjustment of the magnitude of the current is possible by applying a corresponding control signal A1. The result of the comparison is fed to a pulse width modulator 415, which accordingly controls the power switch 416 of the switch mode power supply. The voltage VDD assumes a value required for maintaining the current at a desired level. A diode 417 and an inductor 418 are also included in the switch mode power supply. A control signal M1 may be used for enabling or disabling the switch mode power supply. The power dissipated in the current control circuitry is kept as small as possible and is essentially constant. Any type of switch mode power supply can be used for this concept, including resonant switching-type designs.

As the power dissipated in a display should be as small as possible, and the complexity of the circuit should also be as low as possible, the fourth concept may be considered as a preferred one. In this concept the maximum voltage preferably is kept around 200 V, limiting the number of series-connected LEDs to about 60 to 100. If, for example, 1000 LEDs are arranged in a matrix, 10 to 15 control circuits for controlling the constant current through the LEDs are required. The control circuits could be arranged peripheral to the display. This would, in the case of an LCD screen, have as a further advantage that the heat generated in the control circuits does not affect the function of the LCD panel.

A challenge in the fourth concept is related to controlling the individual switches associated with the LEDs. The switches are usually transistor switches, in which an electrical control signal is used for controlling the on or off state of the switch. The control signal is usually referred to the potential at one electrode of the transistor. The control signal must be large enough to securely control the switching state of the transistor and, at the same time, smaller than the maximum allowable control signal of the respective switch. Depending on which switch in a series connection of LEDs is closed for bypassing an LED the reference potential may quickly vary, as the electrode of the transistor to which the control signal is referred is tied to one electrode of the LED. Whenever an LED in the series-connection is bypassed the absolute potential referred to ground of the reference potentials of individual switches varies. A control signal for controlling any of the switches must, therefore, be large enough to effect switching when the respective reference potential to which it is referred is high, and small enough not to exceed the maximum allowable signal level when the reference potential to which it is referred is low.

It is, therefore, desirable to provide a control circuit for an illumination apparatus in a display allowing for globally or locally modulating the intensity of the illumination at high switching speed, high precision and high efficiency.

The apparatus as defined in claim 1 and the dependent sub-claims as well present a solution for globally or locally controlling a backlight.

According to the invention a circuit for illumination apparatus includes two or more illumination means coupled in a series-connection. A common power supply for the series-connection of illumination means develops a voltage between a first and a second supply potential. The common power supply provides an essentially constant current to the series-connection of illumination means. A first switch is associated with each respective illumination means for selectively enabling and disabling the respective illumination means. Each of the respective first switches has a reference potential corresponding to the potential at one of the main current conducting electrodes of its associated illumination means. Each of the respective first switches further has a control electrode, a corresponding control signal being referred to the reference potential. The circuit has a source of respective first control signals for controlling the individual first switches. The source of the first control signals has a reference potential corresponding to one of the supply potentials of the common power supply. A coupling means is associated with each respective first switch for coupling the respective first control signal to the corresponding first switch. The control signal at the control electrode of a first switch is referred to the reference potential of the respective first switch. The coupling means, the switch and the LED are floating with respect to the ground connection. The term floating is used in the sense of not having a fixed absolute potential over time. The coupling means include optical coupling means, such as optocouplers or optically coupled solid-state relays, as well as capacitive or inductive coupling, e.g. via capacitors or transformers. The first switches include transistors, either of the bi-polar or of the MOS-FET type.

In one embodiment of the invention of first switches are connected in parallel to the respective associated illumination means.

In another embodiment a signal holding means is associated with each respective first switch, the signal holding means including a capacitance or a capacitance and a resistance. The signal holding means may form a low-pass filter.

In yet another embodiment a local power supply is associated with each respective illumination means for operating the first switch associated with the illumination means. The local power supply may include diodes and a capacitance in a switched capacitor arrangement.

In the case of an optically coupled control signal for the switch, the power for operating the switch is preferably transmitted by the control signal itself. In this case an optocoupler needs to have a coupling ratio of input signal to output signal that is high enough for fully operating the switch, i.e. fully opening or closing the switch. As the transmission ratio may be somewhat low for currently available optocouplers, an optocoupler having a Darlington transistor output stage is amongst the preferred choices. In this way a high signal transmission ratio for the switched current can be achieved.

Another optically controlled solution for driving an isolated floating switch includes an optical relay, or solid state relay, also known as OptoMOS® switch. OptoMOS® is a registered trademark of Clare, Inc., USA. The solid state relay features a MOS-FET transistor that is switched on or off by a control current transmitted via an optocoupler. The solid state relay provides a high impedance between the current conducting electrodes in the off-state, as well as a low impedance current conducting path between the current conducting electrodes in the on-state. Further, isolation between the control terminal and the current conducting electrodes is provided.

In a further embodiment a source of second control signals is provided. The second control signals are modulated by the first control signals. The second control signals are fed to the coupling means in place of the first control signals. Demodulation means are associated with the first switches for demodulating the second control signals. The demodulated second control signals result in signals corresponding to the first control signals, which are applied to and used for controlling the first switches.

In one embodiment the second control signals are also used for supplying power to the respective local power supplies.

In another development of the invention the demodulation means include a second switch. The second switch is controlled by the second control signals to charge, from the local power supply, the signal holding means associated with the first switches.

The source of the second control signals may include an oscillator, the output of which is modulated by the first control signals. Modulation includes switching on or off the output.

In yet a further embodiment a single oscillator is provided as a source of the second control signals for multiple illumination means. The oscillator's output signal is applied to the input of a multiplexer. The multiplexer selectively applies the oscillator signal as second control signals to one or more coupling means of associated illumination means.

In one embodiment of the invention the oscillator includes an inductance and a capacitance connected with two transistors in a half-bridge arrangement. This embodiment may advantageously also allow for energy recovery. A detailed description of a half-bridge arrangement including an inductance and a capacitance can be found in EP 1 646 143 A, which is hereby incorporated into the specification by reference.

In a further development of the invention the circuit nodes having the same potential as the reference potential of the first switches are switchably connected with a reset potential.

In another embodiment the control electrodes of the first switches are switchably connected with a reset potential.

The switchable connection of circuit nodes to a reset potential may include diodes which are connected in forward direction towards the reset potential.

In a development of the invention the switchable connection is provided via a common connection line. The common connection line is switchably connected to the reset potential via a reset switch.

In a refinement of the invention overvoltage protection means are provided with each respective first switch. The overvoltage protection means are referred to the respective reference potential of the respective first switch.

In a further development of the invention, in which optocouplers are used as coupling means, the LEDs of multiple optocouplers are connected in a matrix-like arrangement. The individual LEDs are addressed in a multiplexed manner. An individual optocoupler is set to conduction mode by accordingly setting the anode electrode of the optocoupler's LED to a higher potential than the cathode electrode of the LED. Accordingly, an individual optocoupler is set to a non-conduction mode by reverse biasing the LED or by setting the anode and the cathode of the LED to the same potential. This embodiment advantageously allows for connecting multiple anodes and cathodes LEDs of optocouplers to the same control lines. By accordingly controlling the levels of the connecting lines in individual LED can be independently addressed. This embodiment of the invention reduces the required number of control lines.

In a method according to the invention for controlling an illumination apparatus having two or more illumination elements arranged in a series-connection and first switches associated with each illumination elements for selectively activating or deactivating the illumination means the series-connection is supplied with an essentially constant current. The first switches associated with the individual illumination means are controlled to be closed or opened for de-activating or activating the corresponding illumination means. A closed first switch provides a bypass for the essentially constant current such that the illumination means essentially does not conduct any current. Nevertheless, the essentially constant current in the series-connection of illumination means is maintained. Depending on whether a first switch is closed or opened a perceived level of illumination can be set. The perceived level of illumination is determined by the ratio of on-time and off-time of the illumination means during a predetermined interval. The first switches may be controlled for example in a pulse density modulation or in a pulse width modulation manner.

In a development of the method according to the invention the essentially constant current may be varied for further adjusting the perceived level of illumination. In the case of illumination means exhibiting a relation between current and radiated spectral range varying the essentially constant current may also be employed for adjusting the hue of the illumination.

The inventive method may further include selectively connecting circuit nodes representing a reference potential for the first switches to a reset potential. Once the circuit nodes representing reference potentials for the first switches are connected to the reset potential, local power supplies associated with each of the respective first switches may be set to an initial voltage. After that the circuit nodes representing reference potentials are disconnected from the reset potential. This embodiment of the inventive method allows for supplying the initial voltage to all of the local power supplies associated with the respective first switches simultaneously, as all local power supplies are connected in parallel when the respective circuit nodes representing reference potentials for the first switches are connected to the reset potential. The initial voltage is in this case the same for all the local power supplies, thereby reducing the circuit complexity and the number of steps for carrying out the method.

In one embodiment of the method the circuit nodes representing reference potentials are connected to the reset potential by closing all first switches associated with illumination means of one series-connection. As the resistances of the switches are essentially zero, the circuit nodes representing reference potentials are connected in parallel to the reset potential. After the initial voltage has been supplied to the local power supplies associated with the respective first switches at least one of the first switches associated with an illumination means of the series-connection is opened.

In case third switches are provided for selectively coupling the circuit nodes representing reference potentials of first switches to a reset potential, the method may include the step of closing the third switches for establishing the desired connection to the reset potential. After the initial voltage has been supplied to the local power supplies associated with the respective first switches the third switches are opened.

In case fourth switches are provided for connecting the control electrodes of the first switches to a reset potential the method may further include closing the fourth switches when the circuit nodes representing reference potentials of first switches are connected to the reset potential. When the initial voltage has been supplied to the local power supplies associated with the respective first switches and the third switches are opened, the fourth switches are also opened. This embodiment of the method allows for resetting the control signal of the first switches. This may be necessary as signal holding means provided with the first switches may still hold a control signal previously applied to it, or fragments thereof.

In case the third or fourth switches are connecting the respective circuit nodes to a common connection line, the line may be provided with a fifth switch for connecting the common connection line to the reset potential. In this case the method may include connecting the respective circuit nodes to the common connection line and connecting the line to the reset potential. After the circuit nodes have been set to the desired potentials, the connections established before are opened.

The invention will now be described in detail with reference to the drawing, in which FIG. 1 shows a first known concept for selectively supplying a current to illumination means;

In the figures, same or similar elements are referenced by the same reference symbols.

FIGS. 1 to 4 have been described further above and will not be referred to in detail again.

Figure 5:
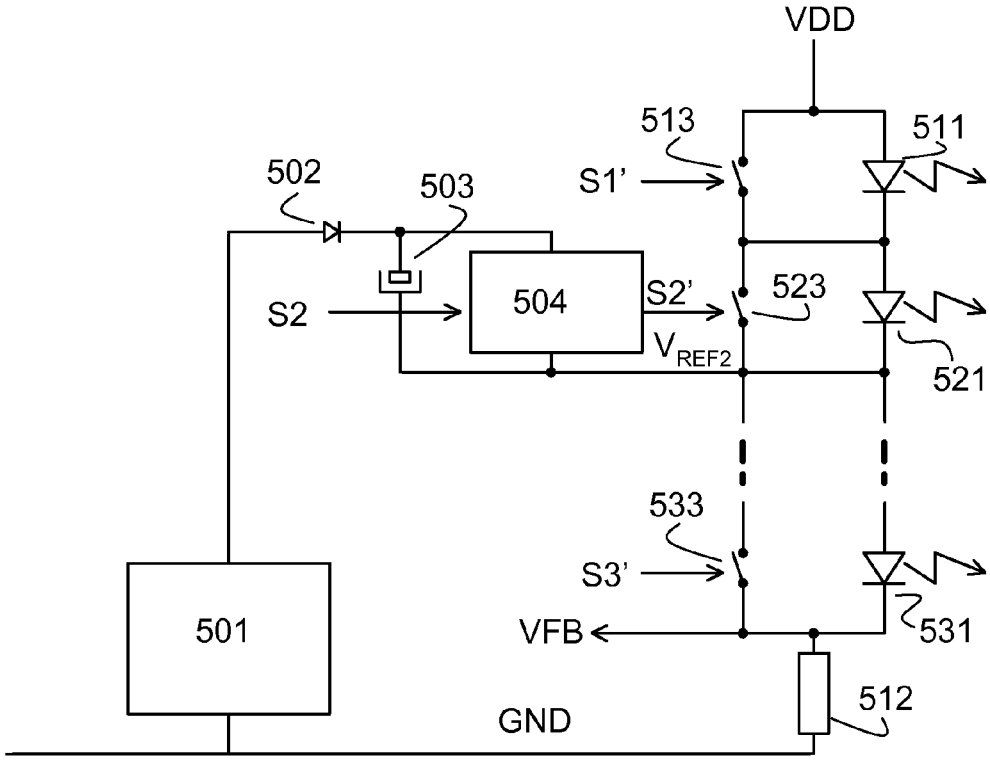
FIG. 5 illustrates a detail of a first embodiment according to the invention for selectively supplying a current to illumination means.

FIG. 5 illustrates a detail of a first embodiment according to the invention for selectively supplying a current to illumination means. A supply voltage VDD is supplied to a series-connection of illumination means 511, 521, 531. A current sense resistor 512 is series-connected between the series-connection of illumination means 511, 521, 531 and a ground potential GND. The supply voltage VDD and the ground potential GND form a first and second potential of the power supply (not shown). First switches 513, 523, 533 are coupled in parallel with respective illumination means 511, 521, 531. The first switches 513, 523, 533 are controlled by control signals S1', S2', S3'. The voltage across the current sense resistor 512 is fed back to the power supply (not shown) for accordingly regulating the supply voltage VDD. A low-voltage power supply 501 is provided for supplying power to local power supplies 503 associated with respective illumination means 511, 521, 531. The local power supply 503 is represented in the figure by a capacitor. A voltage is supplied from the low-voltage power supply 501 to the capacitor 503 via a diode 502. The way the voltage is supplied from the low-voltage power supply 501 to the capacitor 503 via the diode 502 may be construed as a charge pump circuit. Charge pump circuits are known to the person skilled in the art and are, therefore, not discussed in detail here. The coupling means 504 are connected to the local power supply 503. Coupling means 504 receives the control signal S2 and provides a control signal S2' for controlling the switch 523. The control signal S2 may be referred to ground potential GND. The control signal S2' is referred to the reference potential $V_{REF2}$ of the switch 523. The coupling means 504 thus provides a translation of the different reference potentials of the signals S2 and S2'. For clarity reasons only one coupling means 504 and one local power supply 503 are shown in the figure. It goes without saying that the circuit discussed in detail before is provided several times according to the number of illumination means in the series-connection.

Figure 6:
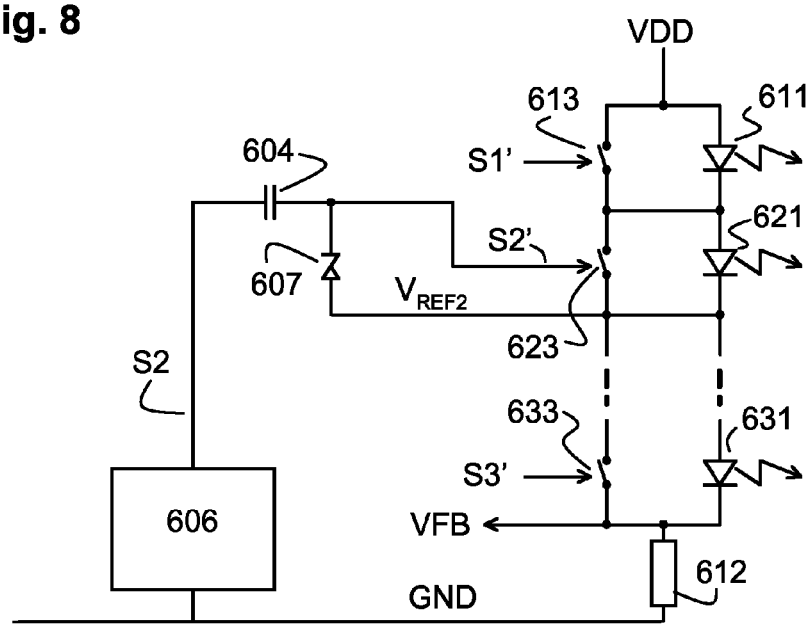
FIG. 6 illustrates a detail of a second embodiment according to the invention for selectively supplying a current to illumination means.

FIG. 6 illustrates a detail of a second embodiment according to the invention for selectively supplying a current to illumination means. The setup of the power supply supplying a supply voltage VDD and ground potential GND, the series-connection of illumination means 611, 621, 631 and the current sense resistor 612 as well as the switches 613, 623, 633 are similar to the setup discussed under FIG. 5. For clarity reasons only one coupling circuit 604 is shown in the figure. A means 606 is provided for generating a control signal S2. The control signal S2 is referred to ground potential GND. The coupling means 604 is a capacitor, which receives a pulse-shaped control signal S2 and passes it as a control signal S2' to a control terminal of the switch 623. The control signal S2' is referred to the reference potential $V_{REF2}$ of the switch 623 and causes switch 623 to assume the desired switching state. An overvoltage protection means 607 is provided between the reference potential $V_{REF2}$ and the control terminal of the switch 623. The overvoltage protection means 607 may include a Zener diode or any other suitable means for limiting a voltage.

Figure 7:
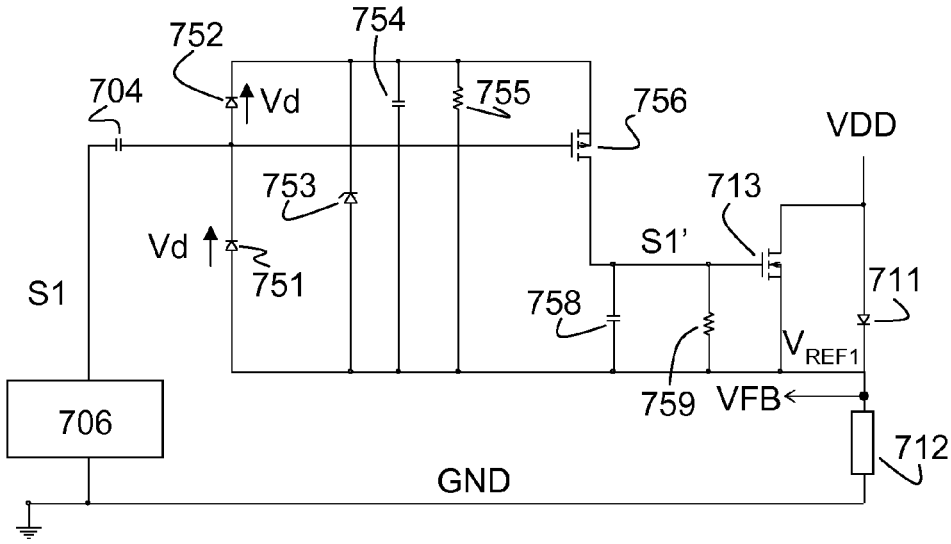
FIG. 7 shows a detail of a third embodiment according to the invention for selectively supplying a current to illumination means.

FIG. 7 shows a detail of a third embodiment according to the invention for selectively supplying a current to illumination means. In the figure only one illumination means and the associated circuitry is shown for simplicity reasons. In a real application multiple illumination means are connected in a series-connection in a similar way as described under FIG. 5 or 6. A power supply (not shown) supplies a supply voltage VDD and a ground potential GND to the illumination means 711. The power supply (not shown) provides a constant current, which is determined using the current sense resistor 712. A switch 713 is connected in parallel to the illumination means 711. A signal generator 706 provides a control signal S1 to a coupling capacitor 704. The control signal S1 is a modulated signal having a predetermined frequency. The shape of the control signal S1 may include, inter alia, sinusoidal waveforms as well as triangular-, saw tooth-, or square-shaped waveforms. The modulation may include simple switching on and off of the signal having the aforementioned waveforms. Modulation is preferably made at a frequency that is substantially lower than the predetermined frequency of control signal S1. The control signal S1 appears for example as bursts of a higher frequency signal. Diodes 751, 752, 753 provide a clamping of the signal downstream of capacitor 704 to the reference potential $V_{REF1}$, such that the signal S1 downstream of capacitor 704 can only swing from minus Vd to the voltage determined by the Zener diode 753, in each case referred to the reference potential $V_{REF1}$. The voltage Vd represents the forward voltage drop of diode 751. The reference potential $V_{REF1}$ is the potential to which a control signal S1' is referred which is used for controlling the switch 713. The control signal S1 downstream of capacitor 704 charges capacitor 754 via diode 752 to a maximum level determined by Zener diode 753. Capacitor 754 represents the local power supply associated with the illumination means 711. While the voltage across capacitor 754 may remain essentially constant, the potentials at both ends of the capacitor may vary with respect to the ground potential GND, depending from the switching states of bypass switches 713 of other illumination means in the same series-connection. The local power supply is thus floating with respect to the ground potential GND. A resistor 755 is provided for discharging capacitor 754. A transistor switch 756 is connected between the local power supply provided by capacitor 704 and a control terminal of switch 713. The signal S1 downstream of capacitor 704 not only charges capacitor 754, but is also applied to a control terminal of transistor switch 756. When the control signal S1 is applied to the circuit transistor switch 756 is controlled to be opened or closed in accordance with the predetermined frequency of the control signal S1. When transistor switch 756 is opened it charges capacitor 758 from the local power supply, thereby generating a voltage across the capacitor 758. The voltage so-generated forms the control signal S1' and is applied to the control terminal of switch 713, which consequently is closed. A resistor 759 is connected in parallel to capacitor 758. Resistor 759 and capacitor 758 form a low pass filter for the control signal S1. As a consequence, the predetermined frequency of the signal S1 is not present in the signal S1'. However, assuming that the signal S1 is switched on or off at a frequency lower than the predetermined frequency of the signal S1, the signal S1' represents the switching on and off of the signal S1. The circuitry may be construed as a demodulation means, which demodulates or reconstructs the signal that is used for modulating control signal S1. The high-frequency control signal S1 is used for operating the charge pump-like local power supply associated with the switch 713, and the sequence of switching on and off the control signal S1 is used for controlling switching on and off the switch 713. By appropriately choosing the predetermined frequency of the control signal S1 and the frequency in which the control signal S1 is switched on and off, a proper discrimination between both frequencies can be achieved in the coupling means by the low pass filter including resistor 759 and capacitor 758. As soon as the control signal S1 downstream of capacitor 704 is switched off transistor switch 756 no longer charges capacitor 758. The remaining charge in capacitor 758 is quickly discharged via capacitor 759 and consequently switch 713 is opened. However, as the discharging is not effected immediately, the low pass filter arrangement may also be construed as a signal holding means. The low pass filter is designed with a hold time short enough such that the reconstructed signal that was used to modulate the control signal S1 is reset within a predetermined time after the modulated control signal S1 is no longer applied. In case other illumination means in the series-connection are bypassed, or at the bypass is opened, the potential of reference voltage $V_{REF1}$ of one or more of the illumination means may change with regard to the ground potential GND. This change in the reference potential $V_{REF1}$ may be interpreted as a single pulse conducted via capacitor 704, or as a common mode interference. However, a single pulse will not be sufficient for charging capacitor 758 to a voltage level which could cause switch 713 to conduct.

The embodiment describe above advantageously provides immunity against common mode interference, which may be introduced due to the switching of some of the switches in a series-connection of LEDs and switches. As was mentioned before, switching of switches associated with the LEDs causes the voltage across the LED to vary, which in turn may influence the individual reference potentials $V_{REFn}$ of switches arranged in the same series-connection. The immunity is due to modulating a higher frequency signal with a lower frequency useful signal, which further allows for making the coupling capacitor smaller. Yet further, common mode interference only affects the floating local supply voltage, which is protected against overvoltage by corresponding protection means. Only an edge or a transition of the common mode signal can pass through the switch added in addition to the switch bypassing the LED, activating it for a short pulse. A single edge pulse occurring at a repetition rate much lower than edges of the modulated control signal, however, is not sufficient for creating a signal in the signal holding means that is large enough for activating the switch associated with the LED. In one exemplary embodiment the modulation frequency for the control signal is in the range of 500 kHz, i.e. 2 μs intervals, whereas the a common mode interference due to switching has a minimal interval of 13.3 μs, assuming the switches associated with the LEDs are operated 10 times within a frame period. In this case only a signal downstream of the coupling capacitor having edges recurring at intervals smaller than 13.3 μs must be interpreted as a control signal. The duration of the 500 kHz burst of the modulated control signal determines the time during which the bypass switch associated with the LED is closed.

Figure 8:
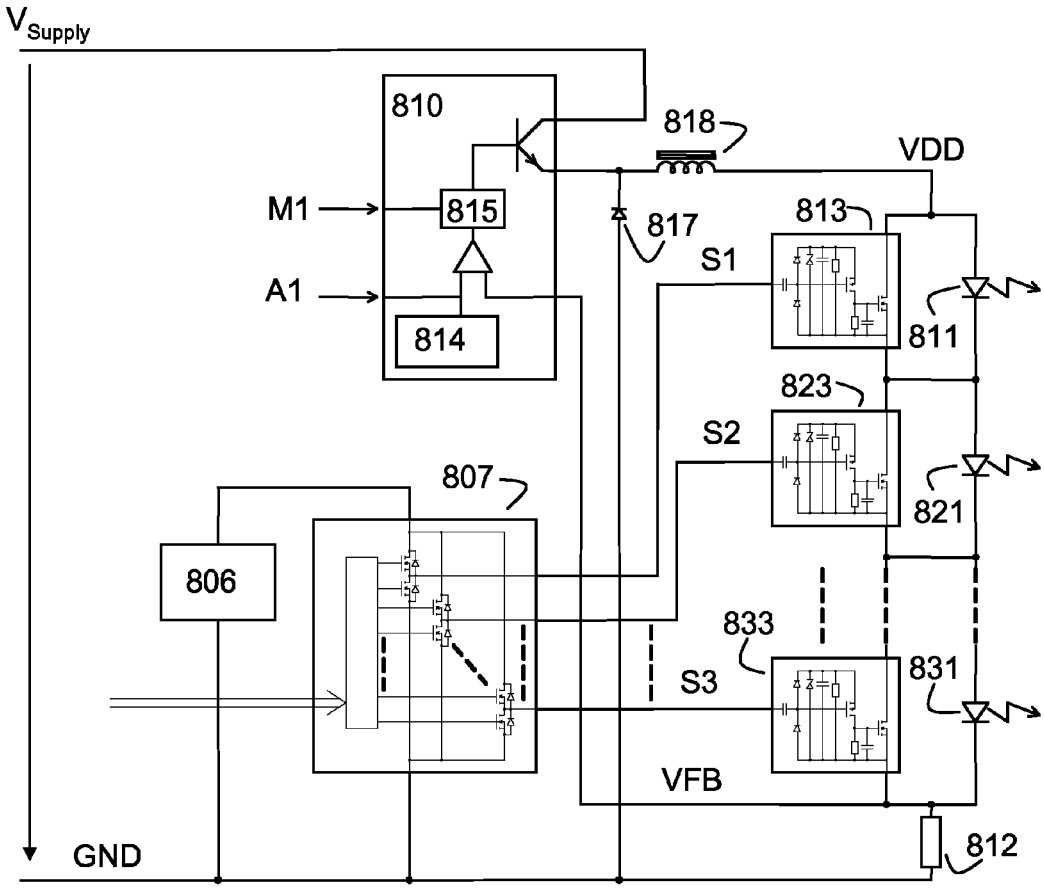
FIG. 8 shows a refined concept according to the invention for selectively supplying a current to illumination means.

FIG. 8 shows a refined concept incorporating the third embodiment of the invention for selectively supplying a current to illumination means. In the figure illumination means 811, 821, 831 and their associated switches 813, 823, 833 as well as a current sense resistor 812 are shown in a series-connection. For clarity reasons the reference signs 813, 823, 833 refer to both the switch and the associated coupling means together. A switch mode power supply 810 including an inductor 818 and a diode 817 provides a constant current through the series-connection. The switch mode power supply survey includes a pulse width modulator 815 and in internal reference 814. Control signals M1 and A1 are provided for enabling the switch mode power supply and for adjusting the essentially constant current. A single signal generator 806 is provided for controlling all illumination means in the series-connection. The output signal coming from the single signal generator 806 is fed to a distribution means 807. The distribution means 807 selectively applies the signal provided by the single signal generator 806 to one or more switches 813, 823, 833 via the respective associated coupling means. To this end, the distribution means 807 may comprise multiplexing means and amplifying means. The distribution means 807 are also used for modulating the signal coming from the single signal generator 806, i.e. switching the signal on and off. Distribution means 807 preferably is controlled via a digital interface receiving information about the desired status of the switches.

Figure 9:
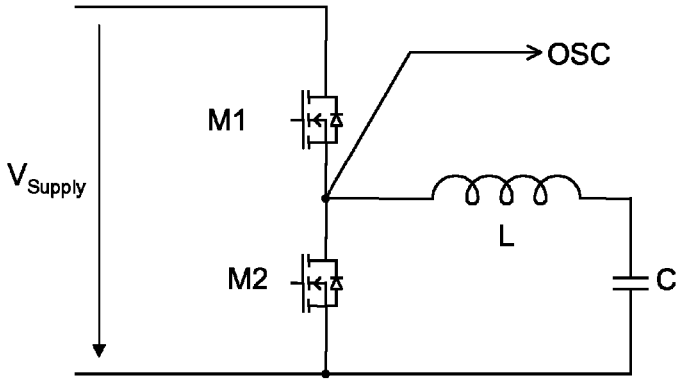
FIG. 9 depicts a basic concept of an oscillator used in an embodiment of the invention.

FIG. 9 depicts a basic concept of an oscillator used in an embodiment of the invention. A supply voltage $V_{Supply}$ is provided to two transistors M1 and M2 connected in a half-bridge arrangement. From the centre point of the half-bridge arrangement a series-connection of an inductance L and a capacitance C is tapped off to ground. When transistors M1 and M2 are accordingly controlled an oscillation signal OSC is present at the centre point of the half-bridge arrangement. The energy of the oscillation signal OSC is sufficient to be directly distributed via switches without the need of further amplification. Losses in the circuit essentially originate from resistive losses in the components, in particular resistive losses in the inductance L and in the on-resistance of transistors M1 and M2. When transistors M1 and M2 are properly controlled, essentially no further energy is dissipated.

Figure 10:
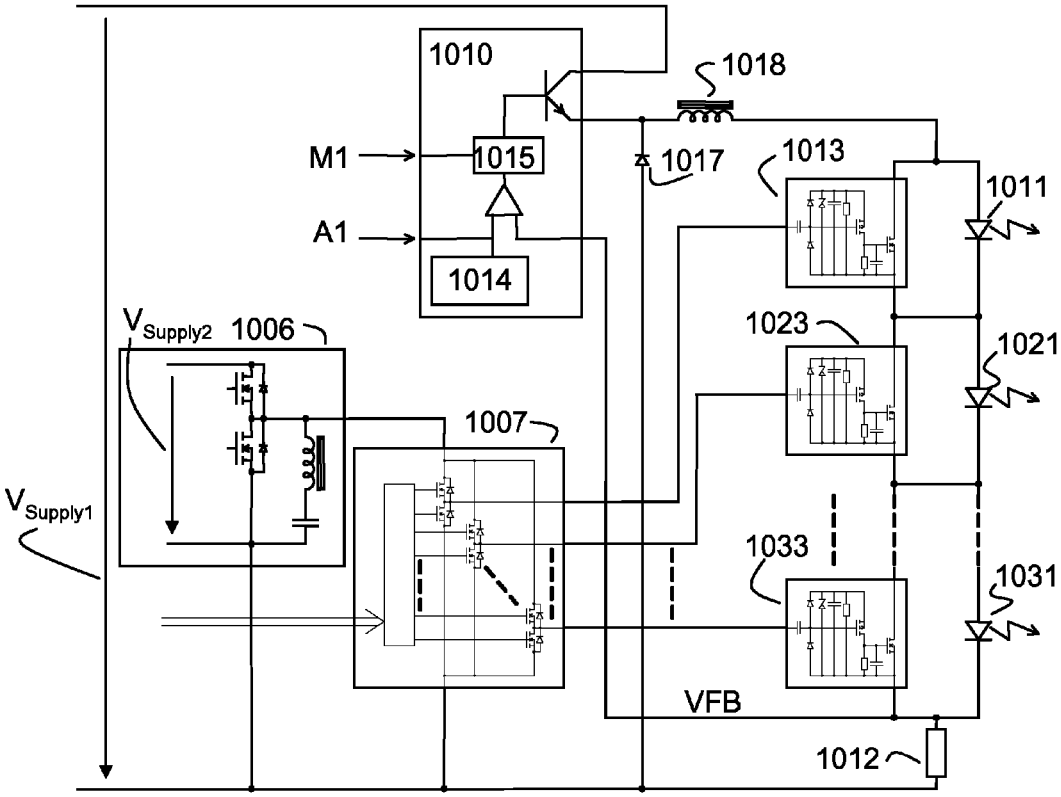
FIG. 10 shows the refined concept of FIG. 8 including the oscillator of FIG. 9.

FIG. 10 shows the refined concept of FIG. 8 including the oscillator of FIG. 9. The overall circuit including illumination means 1011, 1021, 1031, switches 1013, 1023, 1033, current sense resistor 1012, switch mode power supply 1010, inductance 1018 and diode 1017 is similar to the one described under a FIG. 8. Switch mode power supply 1010 can likewise be controlled by control signals M1 and A1 and likewise includes a pulse width modulator 1015 and an internal reference 1014. A first supply voltage $V_{Supply1}$ is supplied to the switch mode power supply 1010. The circuit further includes an oscillator 1006 of the type described under FIG. 9. The oscillator 1006 is connected to a power supply providing a second supply voltage $V_{Supply2}$. A distribution means 1007 receives the output signal from oscillator 1006 and distributes it to the switches 1013, 1023, 1033.

Figure 11:
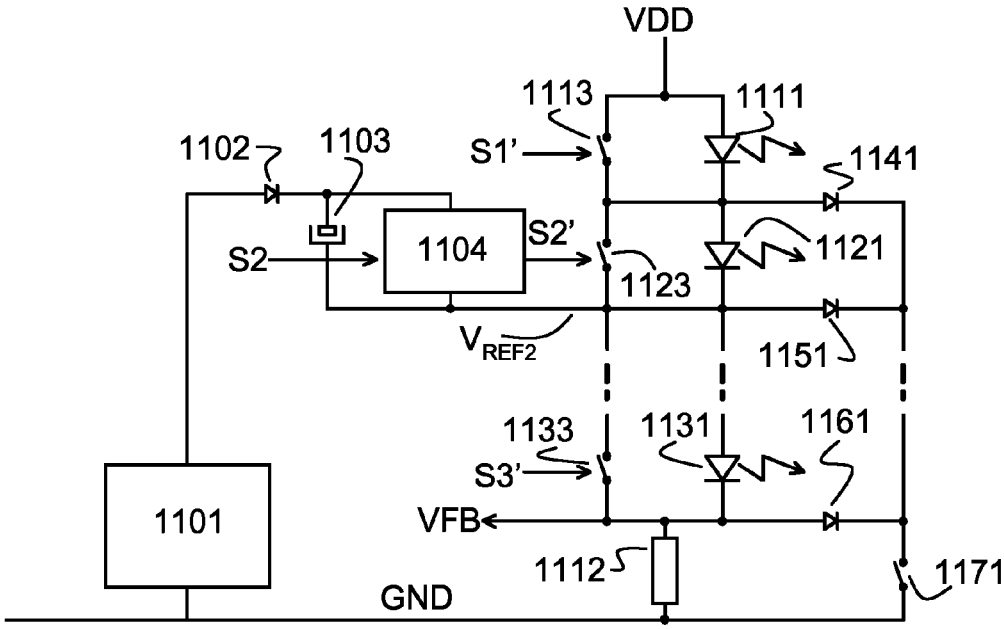
FIG. 11 illustrates a basic concept of a further embodiment of the invention.

FIG. 11 illustrates a basic concept of a further embodiment of the invention. The circuit shows essentially the same elements as described further above under FIG. 5. A supply voltage VDD is supplied to a series-connection of illumination means 1111, 1121, and 1131. A current sense resistor 1112 is series-connected between the series-connection of illumination means 1111, 1121, 1131 and a ground potential GND. The supply voltage VDD and the ground potential GND form a first and second potential of the power supply (not shown). First switches 1113, 1123, and 1133 are coupled in parallel with respective illumination means 1111, 1121, and 1131. The first switches 1113, 1123, and 1133 are controlled by control signals S1', S2', S3'. The voltage across the current sense resistor 1112 is fed back to the power supply (not shown) for accordingly regulating the supply voltage VDD. A low-voltage power supply 1101 is provided for supplying power to local power supplies 1103 associated with respective illumination means 1111, 1121, and 1131. The local power supply 1103 is represented in the figure by a capacitor. A voltage is supplied from the low-voltage power supply 1101 to the capacitor 1103 via a diode 1102. The way the voltage is supplied from the low-voltage power supply 1101 to the capacitor 1103 via the diode 1102 may be construed as a charge pump circuit. Charge pump circuits are known to the person skilled in the art and are, therefore, not discussed in detail here. The coupling means 1104 are connected to the local power supply 1103. Coupling means 1104 receives the control signal S2 and provides a control signal S2' for controlling the switch 1123. Control signal S2 may be referred to ground potential GND. The control signal S2' is referred to the reference potential $V_{REF2}$ of the switch 1123. Coupling means 1104 thus provides a translation of the different reference potentials of the signals S2 and S2'. For clarity reasons only one coupling means 1104 and one local power supply 1103 are shown in the figure. It goes without saying that the circuit discussed in detail before is provided several times according to the number of illumination means in the series-connection. Further to the circuit described here above, which is essentially identical to the circuit described under FIG. 5, diodes 1141, 1151, and 1161 and a switch 1171 are provided. Diodes 1141, 1151, and 1161 are connected with their anode terminals to the circuit nodes of reference potential of respective illumination means 1111, 1121, and 1131. Diodes 1141, 1151, and 1161 are connected to switch 1171 via a common connection line. Diodes 1141, 1151, and 1161 may be construed as switches for selectively connecting the circuit nodes of reference potential in parallel. As the local power supplies are referred to the respective reference potential of the associated illumination means, the local power supplies reference potential when the switches are closed and the circuit nodes of the reference potential are connected in parallel. The low-voltage power supply 1101 may now charge all local power supplies to the same voltage. When the switches are opened the circuit nodes of reference potential of the associated illumination means assume different values depending on the switching state of the switches 1113, 1123, in 1133 in the series-connection. A method for controlling accordingly provides a step of closing the switches 1141, 1151, 1161, and 1171 for synchronised charging of the local power supplies 1103 associated with the respective switching means 1113, 1123, and 1133. When the switches 1141, 1151, 1161, and 1171 are opened normal operation is resumed.

Figure 1:
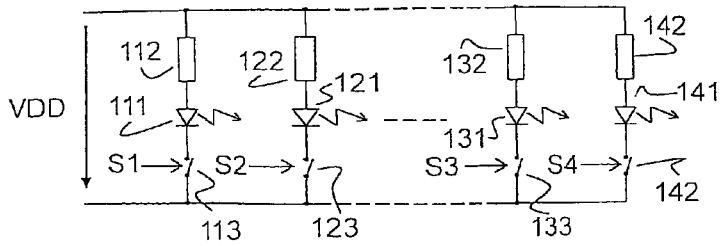
Fig. 1 Prior Art
Figure 2:
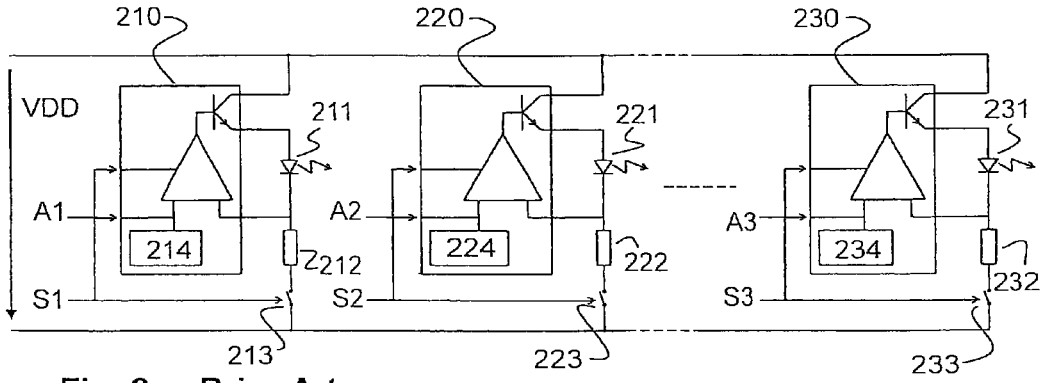
Fig. 2 Prior Art
FIG. 2 shows a second known concept for selectively supplying a current to illumination means.
Figure 3:
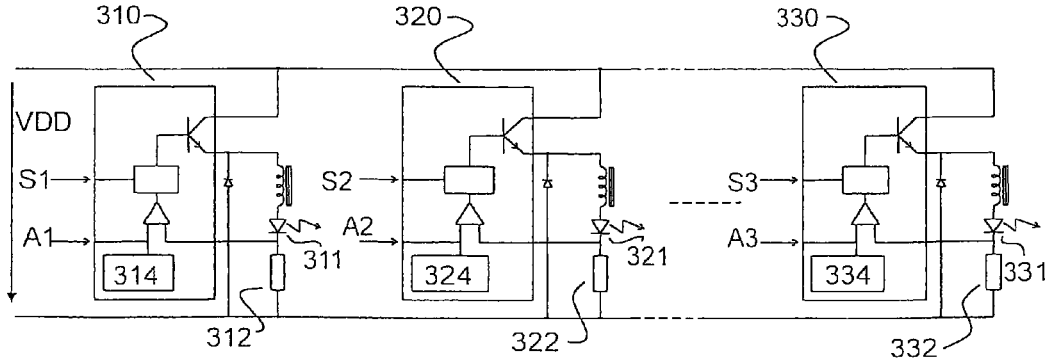
Fig. 3 Prior Art
FIG. 3 illustrates a third known concept for selectively supplying a current to illumination means.
Figure 4:
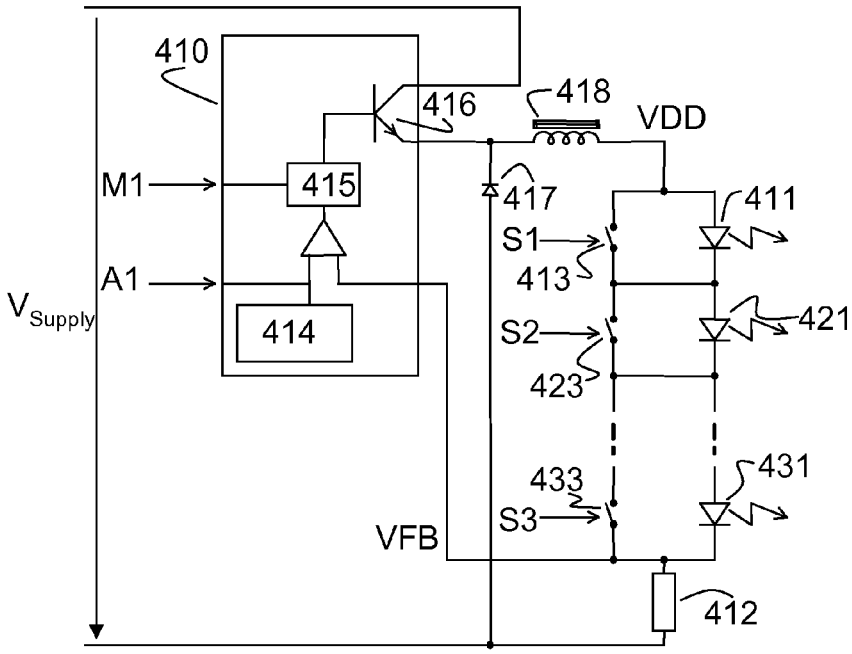
FIG. 4 shows a basic concept according to the invention for selectively supplying a current to illumination means.
Figure 12:
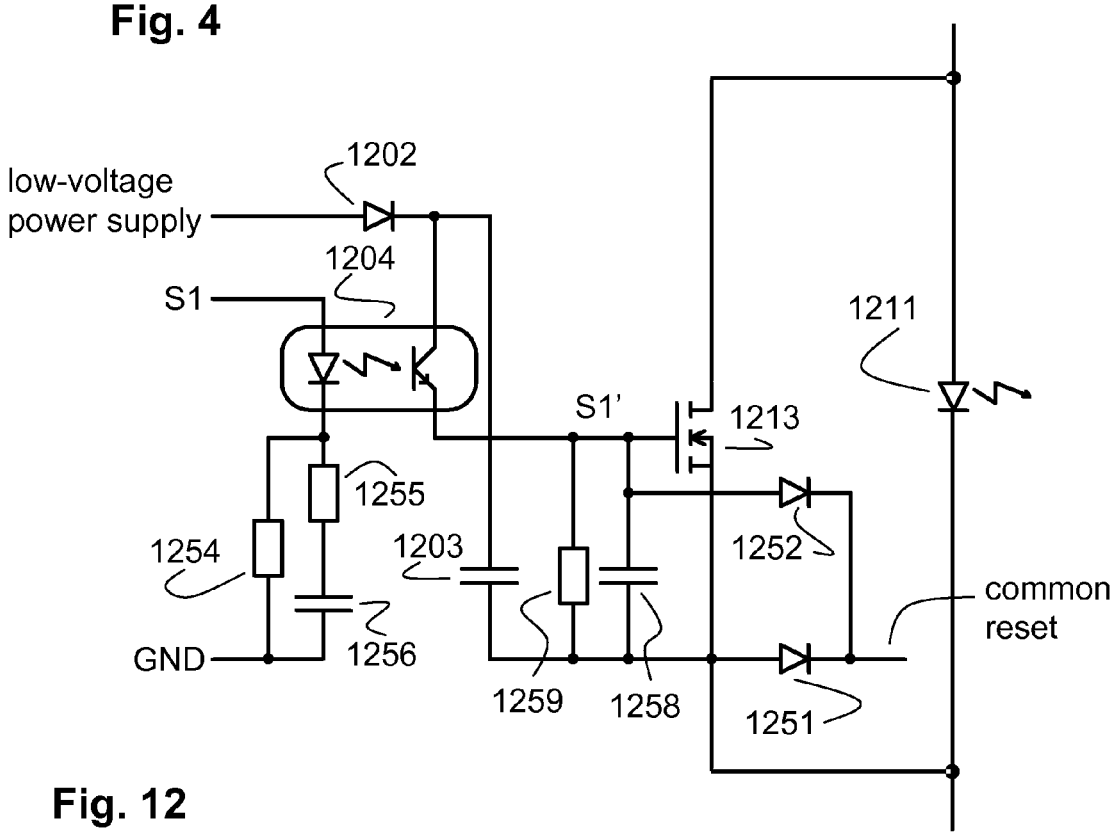
FIG. 12 shows an embodiment of a coupling circuit for controlling a switch having a floating reference potential for the control signal used with the further concept shown in FIG. 11.

FIG. 12 shows an embodiment of a coupling circuit for controlling a switch having a floating reference potential for the control signal used with the further concept shown in FIG. 11. For clarity reasons only a single illumination element 1211 and the associated switch 1213 is shown in the figure. It is obvious that a multiplicity of like circuits are connected in series in an illumination apparatus according to the invention. A local power supply 1203 is charged via a diode 1202 from a low-voltage power supply (not shown). In optocoupler is used in this embodiment as coupling means 1204. The optocoupler charges a signal holding means including resistor 1259 and capacitor 1258 from the local power supply 1203 when controlled accordingly. The LED of the optocoupler is controlled by an according control signal S1. This signal holding means provide a control signal S1' to a control terminal of switch 1213. For proper driving of the LED of the optocoupler 1204 a series-connection of a resistor 1255 and a capacitor 1256 is connected in parallel to a resistor 1254, which determines the current through the LED of the optocoupler in steady state. When the optocoupler is switched on the signal holding means is charged from the local power supply. When the potential at the control terminal of the switch exceeds a threshold the switch is closed and the current through the illumination means is bypassed. The illumination means is consequently no longer lit. When the optocoupler is switched off the signal holding means is no longer charged. The capacitor of the signal holding means is discharged by the resistor coupled in parallel to the capacitor. Once the potential at the control terminal of the switch falls below the threshold required for closing the switch, the switch is opened. The current through the illumination means is no longer bypassed and consequently the illumination means is lit. This embodiment of a coupling circuit only needs a simple signal controlling the optocoupler to be on or off. It can be combined with any of the arrangements mentioned above for providing a floating local power supply associated with an illumination means. In order to provide for proper charging of the local power supply a switch 1251, e.g. a diode, is provided. As explained under FIG. 12 the switch is closed when the local power supply 1203 is charged. A further switch 1252 may be provided for discharging the signal holding means in a controlled manner when the local power supply is charged. Switches 1251 and 1252 also provide immunity against transient currents due to switching when charging the local power supply. Switches 1251 and 1252 ensure that in this case the threshold of the switch 1213 is not exceeded.

Figure 13:
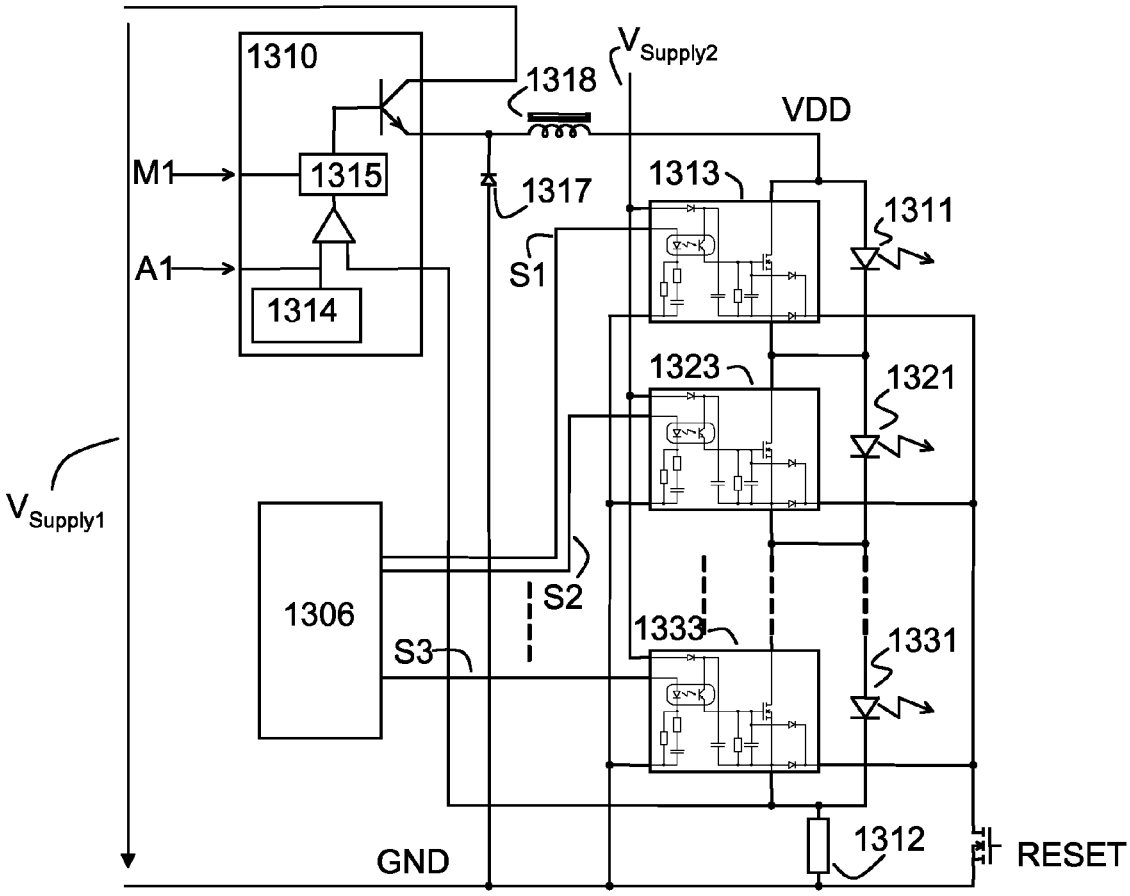
FIG. 13 depicts the concept of FIG. 11 including the coupling circuit shown in FIG. 12.

FIG. 13 depicts the concept of FIG. 11 including the coupling circuit shown in FIG. 12. In the figure coupling means and switches are referenced with the same reference symbol for clarity reasons. The circuit includes a series-connection of illumination means 1311, 1321, 1331 and current sense resistor 1312 connected between a supply voltage VDD and ground GND. Current sense resistor 1312 supplies a feedback to a switch mode power supply 1310, which, via inductance 1318 and diode 1317 adjusts the supply voltage VDD to provide an essentially constant current to the series-connection. The switch mode power supply 1310 may be further controlled via control signals M1 and A1. A first supply voltage $V_{Supply1}$ is provided to switch mode power supply 1310. A low-voltage power supply $V_{Supply2}$ is provided for charging the local power supplies associated with the switches and the illumination means. A control circuit 1306 controls the optocouplers of the coupling means 1313, 1323, and 1333.

Figure 14:
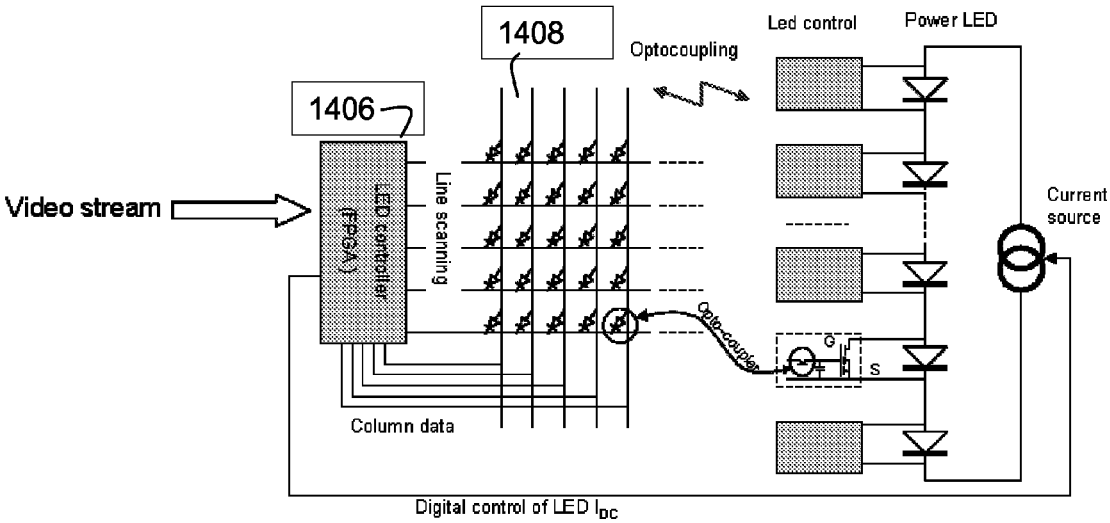
FIG. 14 illustrates a further embodiment of a circuit according to the invention, in which the coupling means are controlled in a multiplexed manner.

FIG. 14 illustrates a further embodiment of a circuit according to the invention, in which the coupling means are controlled in a multiplexed manner. In this embodiment the LEDs of optocouplers of the coupling means are connected in a matrix-like arrangement 1408 to a control circuit 1406. By accordingly controlling individual output lines of the control circuit 1406 individual LEDs of optocouplers of the coupling means can be activated. For proper control of the illumination means a video signal that is to be displayed on a display including the illumination apparatus according to the invention is supplied to the control circuit 1406. The control circuit 1406 may also be used to adjust the otherwise essentially constant current that is supplied to a series-connection of illumination means, thereby allowing for further adjustment of the intensity of illumination.

It is to be noted that the invention can be used for driving a modulated backlight as well as for driving light sources that are arranged in a matrix, forming a screen, wherein one or a group of light sources represents a pixel element of the screen. In the latter case the pixel elements are driven such that various levels of illumination and/or various colours are produced. The colours can, for example, be produced by additive colour mixing through accordingly controlling a set of primary colour light sources forming a pixel element. In this case the totality of individual light emitting elements forms the display.

The invention claimed is:

1. A circuit for an illumination apparatus in a display device including:

two or more illumination means coupled in series;

a common power supply for the series-connection of illumination means developing a voltage between a first and a second supply potential;

a first switch associated with each respective illumination means for selectively enabling and disabling the respective illumination means, wherein each of the respective first switches has a reference potential corresponding to the potential at one of the main current conduction electrodes of its associated illumination means, each switch having a control terminal;

a source of a plurality of first control signals, one first control signal for each first switch, having a reference potential corresponding to one of the supply potentials of the common power supply;

wherein the circuit further includes:

a source of a second control signal, the second control signal being modulated in response to each of the plurality of first control signals, thereby generating a corresponding plurality of modulated second control signals, one for each first switch;

a coupling element associated with each respective first switch for coupling the corresponding modulated second control signal to the control terminal of the first switch, wherein the control signals at the control terminals of the first switches is referred to the respective reference potential of the first switches.

2. The circuit of claim 1, wherein a local power supply is associated with each respective illumination means for operating the respective associated first switches.

3. The circuit of claim 2, wherein the demodulation means include a second switch that is controlled by the second control signals, wherein the second switch charges, from the local power supply, the signal holding means associated with the first switch.

4. The circuit of claim 2, wherein the local power supply includes diodes and a capacitance in a switched capacitor arrangement.

5. The circuit of claim 1, wherein the coupling means includes a demodulation means for demodulating the modulated second control signals and generating demodulated signals corresponding to the first control signals, the demodulated signals corresponding to the first control signals being applied to and controlling the first switches.

6. The circuit of claim 1, wherein the common power supply provides an essentially constant current to the series-connection of illumination means.

7. The circuit of claim 1, wherein the first switches are connected in parallel to the respective associated illumination means.

8. The circuit of claim 1, wherein the coupling means provide optical, capacitive or inductive coupling, and that the first switches include a transistor.

9. The circuit of claim 1, wherein a signal holding means is associated with each respective first switch, wherein the signal holding means includes a capacitance or a capacitance and a resistance.

10. The circuit of claim 1, wherein the modulated second control signals are used for supplying power to the respective local power supplies.

11. The circuit of claim 1, wherein the source of the second control signal includes an oscillator the output of which is modulated by the first control signals.

12. The circuit of claim 11, wherein a single oscillator is provided as a source of the second control signals for multiple illumination means, wherein the oscillator's output signal is applied to the input of a distribution means, wherein the distribution means applies the oscillator signal as second control signals to one or more coupling means of associated illumination means.

13. The circuit of claim 11, wherein the oscillator includes an inductance and a capacitance connected with two transistors in a half-bridge arrangement.

14. The circuit of claim 1, wherein the circuit nodes of reference potential of the first switches and/or the control electrodes of the first switches are switchably connected with a reset potential, wherein the switchable connection includes diodes biased in forward direction towards the reset potential, or transistors.

15. The circuit of claim 14, wherein the switchable connection is provided via a common connection line, and wherein the common connection line is switchably connected to the reset potential via a reset switch.

16. The circuit of claim 1, wherein overvoltage protection means are provided with each respective first switch, the overvoltage protection means being referred to the respective reference potential of the respective first switch.

17. The circuit of claim 1, wherein optocouplers are provided as coupling means, wherein the LEDs of multiple optocouplers are connected in a matrix-like arrangement, wherein the individual LEDs of the optocouplers are addressed in a multiplexed manner, wherein an individual optocoupler is set to a conduction mode by accordingly setting the anode electrode of the optocoupler's LED to a higher potential than the cathode electrode of the LED, and wherein an individual optocoupler is set to a non-conduction mode by accordingly reverse biasing the LED or by setting the anode and cathode of the LED to the same potential.

18. A method for controlling an illumination apparatus in a display, wherein two or more illumination elements are arranged in a series-connection, wherein a switch is provided for each illumination means for selectively activating or deactivating the illumination means, wherein control signals for controlling the switches are referred to respective circuit nodes of reference potential associated with the respective switches and are applied to control electrodes of the switches, and wherein a local power supply is provided with each switch, wherein the local power supplies are referred to the respective reference potential of the switches, the method including the steps of:

supplying the series-connection with an essentially constant current;

providing a plurality of first control signals, one first control signal for each of the switches, for individually controlling the switches associated with respective illumination means;

modulating a second control signal by in response to each of the plurality of first control signals, thereby generating a corresponding plurality of modulated second control signals, one for each of the switches;

providing power to the power supply provided locally with each one of the switches;

selectively controlling the switches associated with the individual illumination means by respective modulated second control signals to activate or deactivate the illumination means, wherein the essentially constant current in the series-connection of illumination means is maintained;

wherein a perceived level of illumination is set by accordingly controlling the ratio of on-time and off-time of the illumination means.

19. The method of claim 18, further including the step of varying the essentially constant current for further adjusting the perceived level of illumination, and/or, in the case of illumination means exhibiting a relation between current and radiated spectral range, for adjusting the hue of the illumination.

20. The method of claim 18, further including the step of:

selectively connecting the circuit nodes of reference potential to a reset potential;

setting the local power supplies to an initial voltage; and disconnecting the circuit nodes of reference potential from the reset potential.

21. The method of claim 20, wherein selectively connecting the circuit nodes of reference potential to a reset potential includes closing all first switches associated with illumination means of one series connection, and disconnecting the circuit nodes of reference potential from the reset potential includes opening at least one of the first switches associated with illumination means of the series-connection.

22. The method of claim 20, wherein third switches are provided for selectively coupling the circuit nodes of reference potential to a reset potential, wherein selectively connecting the circuit nodes of reference potential to a reset potential includes closing the third switches, and disconnecting the circuit nodes of reference potential from the reset potential includes opening the third switches.

23. The method claim 20, further including selectively coupling the control electrodes of the switches to a reset potential when setting the local power supplied to an initial voltage.

* * * * *